United States Patent [19]

Hino et al.

[11] 4,300,358

[45] Nov. 17, 1981

[54] FLAT WALL TYPE REFRIGERATED AND CHILLED OPEN DISPLAY CASE

[75] Inventors: Kazuhiko Hino; Masami Mizutani, both of Kawasaki, Japan

[73] Assignee: Fuji Electric Co., Ltd., Kanagawa, Japan

[21] Appl. No.: 149,657

[22] Filed: May 14, 1980

[30] Foreign Application Priority Data

May 15, 1979 [JP] Japan ..... 54-59530

[51] Int. Cl.[3] ..... A47F 3/04; F25D 21/10

[52] U.S. Cl. ..... 62/256; 62/282

[58] Field of Search ..... 62/255, 256, 278, 282

[56] References Cited

U.S. PATENT DOCUMENTS

| | | | |
|---|---|---|---|
| 3,226,945 | 1/1966 | Spencer | 62/256 |
| 3,850,003 | 11/1974 | Beckwith et al. | 62/282 X |
| 3,937,033 | 2/1976 | Beckwith et al. | 62/282 X |
| 4,120,174 | 10/1978 | Johnston | 62/256 |
| 4,182,130 | 1/1980 | Ljung | 62/256 X |
| 4,245,482 | 1/1981 | Abraham | 62/282 |

*Primary Examiner*—Lloyd L. King

*Attorney, Agent, or Firm*—Price, Heneveld, Huizenga & Cooper

[57] ABSTRACT

A flat wall type refrigerated and chilled open display case having a case opened at its upper region and an air circulation duct having a cold air curtain outlet and a cold air curtain inlet provided at the upper front side and upper rear side of the case so as to oppose to each other across the opened upper region of the case. A cooler associated with a refrigerator, as well as a blower, is disposed in the air circulation passage, so that, during the chilling operation, a cold air is blown out of the cold air curtain outlet toward the cold air curtain inlet to form a cold air curtain which covers the opened upper region of the case. According to the invention, the blower disposed in the air circulation duct is reversible and the display case further comprises a defrosting air duct which opens at its one end to the ambient air and at its other end at a position confronting the cold air curtain outlet, and an ambient air blower disposed in the defrosting air duct. In the defrosting operation, the blower in the air circulation duct is reversed and the ambient air blower is operated to forcibly feed the hot ambient air into the air circulation duct through the defrosting air duct and the cold air curtain outlet thereby to effect a defrosting on the cooler disposed in the air circulation duct. The air after the defrosting is discharged to form an air curtain covering the opened upper region of the case of effectively prevent the hot ambient air from coming into the case.

1 Claim, 2 Drawing Figures

FLAT WALL TYPE REFRIGERATED AND CHILLED OPEN DISPLAY CASE

BACKGROUND OF THE INVENTION

The present invention relates to a flat wall type refrigerated and chilled open display case, suitable to be placed in close proximity of and in parallel with a wall of a store or the like and, more particularly, to a defrost device for such a display case.

Such a flat wall type refrigerated and chilled open display case has been known as adapted to be placed in close proximity of and in parallel with a wall of a store or the like.

In the known display case of the kind described, however, it is necessary to effect a frequent defrosting operation periodically, e.g. four to six times a day in the case where the mean temperature and humidity in the store are 27° C. and 55%, by means of an electric defrost heater, as will be described in detail later with reference to the drawings. The electric defrost heater consumes a power of, for example, about 2.5 Kw which amounts to a lot in a long-term operation of the display case. This electric power does not directly contribute to the refrigeration and chilling which are the major objects of the display case.

SUMMARY OF THE INVENTION

It is, therefore, a major object of the invention to provide a flat wall type refrigerated and chilled open display case in which the defrosting operation is performed by making use of a large enthalpy possessed by the air in the store to eliminate the electric defrost heater to save the electric power during defrosting and to effectively restrain the temperature rise of the content during the defrosting.

To this end, according to the invention, there is provided a flat wall type refrigerated and chilled open display case having an air circulation duct provided with a cold air circulation blower, characterized in that the cold air circulation blower is of reversible type and characterized by comprising a defrosting air duct having an air outlet confronting the cold air curtain outlet of the display case and an air inlet opening in the ambient air, and an ambient air blower for introducing ambient air into the defrosting air duct; whereby, during the defrosting, the ambient air is introduced into the cold air circulation duct to effect a defrosting from the cooler, by a cooperation of the cold air circulation blower which is reversed in this case and the ambient air blower, while the air after the defrosting is discharged to the area above the case from an air curtain inlet thereby to form an air curtain.

The above and other objects, as well as advantageous features of the invention will become more clear from the following description of the preferred embodiments taken in conjunction with the accompanying drawings.

DESCRIPTION OF THE PREFERRED EMBODIMENTS

Before turning to the description of the preferred embodiment, a description will be made hereinunder as to the typical conventional flat wall type refrigerated and chilled open display case (referred to simply as display case, hereinunder), in order to clarify the drawbacks of the prior art and, hence, the technical subjects to be achieved by the present invention.

Figure 1:
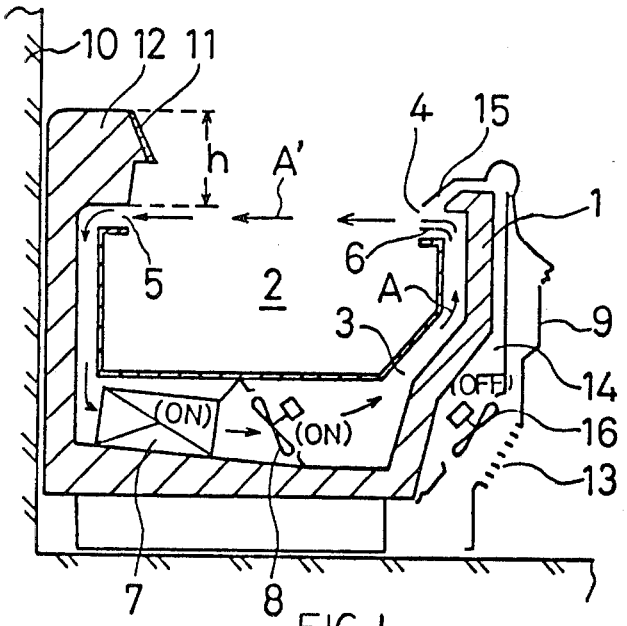
FIGS. 1 and 2 are schematic illustration of a display case in accordance with the invention, in the state of operation for refrigeration and chilling and in the state of operation for defrosting, respectively.

Referring to FIG. 1, a display case designated generally at a reference numeral 1 is opened at its upper side and accomodates a display cell generally denoted by a numeral 2. A reference numeral 3 denotes an air circulation duct defined between the case 1 and the display cell 2. The duct 3 has an outlet 4 and an inlet 5 which are disposed on the upper edge of the case 1 at the front and rear parts of the latter so as to oppose to each other, thereby to form an air curtain of chilled air on the opened upper side of the case 1. A reference numeral 6 designates vanes disposed in the outlet 4 and adapted for forming a laminar flow of cold air coming out from the outlet 4. Reference numerals 7 and 8 designate a cooler and a blower, respectively, disposed in the duct 3. A decorative panel constituting the front wall of the case 1 is designated at a reference numeral 9. The cooler 7 is an evaporator which is connected to a condensing unit of a refrigerator. The display case having the described construction is placed such that its rear surface is held in close proximity of and in parallel with a wall 10 of a store or the like.

The cooler 7 and the blower 8 run during the refrigerating and chilling operation of the display case, so that the cold air after a heat exchange with the cooler 7 is made to flow through the duct 3 in the direction of an arrow A and is discharged from the air curtain outlet 4. The air is then blown into and sucked through the air curtain inlet 5, to form a cold air curtain which covers the opened upper side of the case 1.

The cold air curtain A′ serves to chill the space within the case while shielding the latter against the ambient air. In addition, the display case of the kind described usually has a rear stepped wall 12 which projects above the upper opened region of the case 1, in order to obtain a more attractive appearance and to enhance the displaying effect by attaching thereto a panel 11 for the displayed goods. The goods are taken into and out of the case from the front side of the latter, so that the layout of the structure of rear side of the case 1 is not directly restricted from the view point of service to the customers such as facilitation of picking out of the goods. Therefore, factors such as height h of the step 12 of the rear wall, design of the step 12, level of the air curtain inlet 5 in relation to the outlet 4 can be selected with a comparatively large degree of freedom. Therefore, if the air curtain A′ is arranged such that the air flows from the front side to the rear side of the case 1, the step 12 of the rear wall of the case 1 serves as a guide for the cold air, so that the leak of cold air is reduced even when the flowing velocity is increased, as compared with the case where the cold air constituting the air curtain A′ is directed from the rear side to the front side of the case 1. Thus, the arrangement in which the cold air is directed from the rear side to the front side of the case offers a combined advantage of increased flowing velocity and enhanced chilling effect. To the contrary, if the cold air curtain A′ is constructed such that the cold air is blown out from the rear side of the case toward the front side of the same, the cold air cannot be collected by the cold air circulation duct if the flowing velocity of the air is increased, so that a part of air is leaked to overflow from the front end of the case. Thus, the front blow-out system in which the cold air constituting the cold air curtain is blown out from the front side and directed to the rear side of the case is preferred to the rear blow-out system in which the cold air is blown out from the rear side of the case toward the front side of the same.

During the chilling operation, a small amount of ambient air is inevitably mixed with the cold air of the cold air curtain A' and is made to flow through the cold air circulation duct 3. As a result, the moisture content of the ambient air is frozen and deposited on the fins of the cooler 7 in the form of ice or frost, as the display case operates for long time. The ice and frost then grows, as the display case is operated further, to occupy the whole space between the adjacent fins of the cooler 7 to obstruct the flow of air through this space.

It is, therefore, necessary to employ a predetermined defrosting period to melt and discharge the ice and frost, while suspending the refrigerating and chilling operation, after a predetermined working period.

Various defrosting systems have been practically used such as hot-gas defrosting system, electric-heater defrosting system and so forth, among which the electric-heater defrosting system is used most commonly due to its simple construction.

The most important requisite for the defrosting operation is to minimize the time length required for the defrosting while suppressing the temperature rise of the goods stored in the display case, because the cooler 7 does not operate during the defrosting operation.

In ordinary display case employing the electric-heater defrosting system, 4 to 6 defrosting operations, each lasting 30 minutes, are conducted per day, assuming that the mean temperature and humidity in the store are 27° C. and 55%, respectively. The capacity of the defrosting heater is, for example, about 2.5 Kw, so that a considerably large amount electric power is consumed throughout a long operation solely for the defrosting purpose which does not directly contribute to the refrigeration and chilling which are the main function of the refrigerated and chilled display case.

These drawbacks of the prior art are completely eliminated by the present invention, as will be fully realized from the following description of the preferred embodiments.

Referring again to FIGS. 1 and 2, a louver 13 which constitutes the inlet for the ambient air is provided in the lower part of a front panel 9 of the case. A defrosting air duct 14 is disposed at the inside of the front panel 9 so as to communicate with the louver 13. This defrosting air passage 14 extends upward along the front wall of the case 1 and has an ambient air outlet 15 at the top of the front wall so as to oppose to the outlet 4 of the cold air curtain 4. An ambient air blower 16 for forcibly feeding the ambient air is disposed behind the louver 13. For obtaining a higher temperature of the ambient air, it is preferred to locate the louver 13 at a level as high as possible from the floor. A blower 8 disposed in the aid circulation duct 3 is of reversible type, so that the flowing direction of air in the duct 3 is changeable in accordance with an operation instruction.

Figure 2:
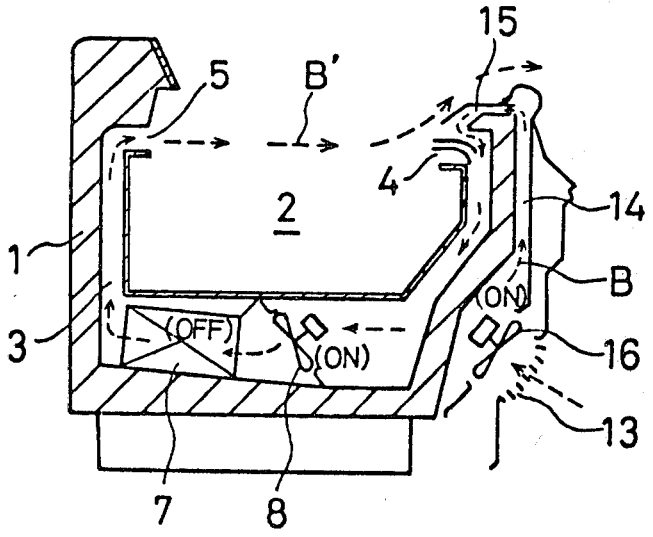

Hereinafter, a description will be made as to the defrosting operation, with specific reference to FIG. 2. As the operation mode is switched from chilling operation to defrosting operation by the control of a timer, the refrigerator and, accordingly, the cooler stop to operate and, at the same time, the blower 8 is reversed. Simultaneously, the ambient air blower 16 for the defrosting purpose starts to operate. In consequence, the ambient air having a large enthalpy is sucked through the louver 13 as shown by a broken-line arrow B and flows the air passage duct 14 to reach the cold air curtain outlet 4 of the case 1 through the air passage duct 14 and is induced into the cold air circulation duct 3 due to the action of the blower 8. The flow B of ambient air delivers heat to the cooler 7 as it moves across the latter, thereby to effect the defrosting on the cooler 7. The ambient air which has been cooled as a result of a heat exchange with the cooler 7 then flows to the cold air curtain inlet 5 and is discharged from the latter to flow over the opened upper region of the case 1 in the form of a laminar flow, thereby to form an air curtain which effectively shields the display cell 2 from the ambient air of high temperature. During the defrosting operation, almost no vacuum is imposed on the cold air curtain outlet 4 because the ambient air is forcibly fed into the latter through the air passage duct 14. Therefore, the laminar flow B' is deflected upward at a point just in front of the cold air curtain outlet 4 and is discharged to the outside of the display case overflowing the upper edge of the front panel of the case 1, without entering again the cold air circulation duct 3. This overflow of the laminar flow B' conveniently prevents the ambient air of high temperature from coming into the display cell 2 thereby to suppress the temperature rise of the good during the defrosting operation. In addition, since the laminar flow B' is never short-circuitted to the cold air circulation duct 3, it is possible to obtain a high defrosting performance.

As will be clear from the foregoing description, according to the invention, it is possible to eliminate the conventional heater specifically used for the defrosting and to greatly save the electric power. Although an ambient air blower 16 is required additionally, the capacity of this blower is about 0.4 Kw or so which is much smaller than that of the conventional defrost heater. In consequence, according to the result of an experimental calculation, about 70% reduction of electric power consumption is achieved during the defrosting operation. The electric power saved during the whole period of operation including the chilling operation mode is as high as about 7.5%. In addition, the temperature rise of the goods on display during the defrosting operation is suppressed because the invasion by the hot ambient air is effectively prevented by the air curtain formed by the discharged air after the defrosting to cover the opened upper region of the case.

It will be clearly understood that the present invention provides a flat wall type refrigerated and chilled open display case which is much improved over the conventional ones in both aspects of energy saving and defrosting and chilling performance.

Although the invention has been described through its preferred form, it will be clear to those skilled in the art that the described embodiment is only for illustrating purpose, and various changes and modifications may be imparted thereto without departing from the scope of the invention which is limited solely by the appended claim.

What is claimed is:

1. In a flat wall type refrigerated and chilled open display case of a type having a case opened at its upper side and having therein a goods displaying cell; an air circulation duct having a cold air curtain outlet and a cold air curtain inlet provided at the front and rear sides of said case and opposing to each other across the opened upper region of said case; and a cooler and a blower disposed in said air circulation passage such that cold air is blown out from said cold air curtain outlet toward said cold air curtain inlet so as to form a cold air curtain covering the opened upper region of said case during chilling operation; an improvement which comprises that said blower disposed in said air circulation passage is reversible and characterized by comprising: a defrosting air duct disposed in said case, said defrosting air duct having an ambient air inlet opened to the ambient air and an ambient air outlet opened to confront said cold air curtain outlet; and an ambient air blower disposed in said defrosting air duct; whereby, in the defrosting operation, said blower in said air circulation passage is reversed and said ambient air blower is operated to forcibly introduce the ambient air into said air circulation duct through said defrosting air duct and said cold air curtain outlet, thereby to effect a defrosting on said cooler, while the air after the defrosting is discharged through said cold air curtain inlet to the opened upper region of said case thereby to form an air curtain which prevents the ambient air of high temperature from coming into said display cell.

* * * * *